US011919681B2

(12) United States Patent
Li et al.

(10) Patent No.: US 11,919,681 B2
(45) Date of Patent: Mar. 5, 2024

(54) COVER ASSEMBLY AND PACKAGING BOX

(71) Applicant: Wm. Wrigley Jr. Company, Chicago, IL (US)

(72) Inventors: Changdan Li, Guangzhou (CN); Xinqin Zhang, Guangzhou (CN)

(73) Assignee: Wm. Wrigley Jr. Company, Chicago, IL (US)

( * ) Notice: Subject to any disclaimer, the term of this patent is extended or adjusted under 35 U.S.C. 154(b) by 0 days.

(21) Appl. No.: 17/728,840

(22) Filed: Apr. 25, 2022

(65) Prior Publication Data

US 2022/0340338 A1 Oct. 27, 2022

(51) Int. Cl.
*B65D 43/20* (2006.01)
*B65D 43/16* (2006.01)

(52) U.S. Cl.
CPC ..... *B65D 43/20* (2013.01); *B65D 43/164* (2013.01); *B65D 2251/0018* (2013.01); *B65D 2251/0081* (2013.01)

(58) Field of Classification Search
CPC .. B65D 5/38; B65D 2583/0454; B65D 5/728; B65D 11/12; B65D 2215/02; B65D 43/20
See application file for complete search history.

(56) References Cited

U.S. PATENT DOCUMENTS

2007/0062964 A1* 3/2007 Kampf ..... B65F 1/1623 220/4.23
2008/0060975 A1* 3/2008 Young ..... B65D 11/12 206/745
2010/0213221 A1 8/2010 Vogel et al.
2017/0137167 A1* 5/2017 Warner ..... B65D 43/22

FOREIGN PATENT DOCUMENTS

KR 100800410 B1 * 2/2006 ..... A45D 40/221
WO 2008024358 A2 2/2008

* cited by examiner

*Primary Examiner* — Shawn M Braden

(57) ABSTRACT

The disclosure provides a cover assembly and a packaging box, wherein the cover assembly comprises: a shield provided with an opening; a sliding cover slidably arranged on the shield; a lid located between the shield and the sliding cover and rotatably connected to the shield, so that the opening can be opened or closed under the drive of the sliding cover. The cover assembly provided by the disclosure can directly drive the lid to move by means of the sliding cover during the sliding process, so that the lid can open or close the opening, with the whole structure being small and delicate, easy to operate for the user, and at the same time reducing the cost of the cover assembly to ensure the storage of stuff inside the box body of the packaging box.

15 Claims, 7 Drawing Sheets

COVER ASSEMBLY AND PACKAGING BOX

TECHNICAL FIELD

The disclosure relates to the technical field of packaging, in particular, to a cover assembly and a packaging box.

BACKGROUND ART

Packaging boxes are very common in daily life and can be used to store candies and other foods, which are convenient for users to carry around. In the related art, the packaging box usually directly opens or closes the discharge port through a sliding cover, the sealing method of which results in poor sealing effect of the discharge port. In addition, the structure of the cover assembly of the packaging box in the related art is complicated, which is inconvenient for processing and manufacturing.

SUMMARY OF THE INVENTION

The disclosure is intended to solve at least one of the technical problems existing in the prior art.

To realize this object, a first aspect of the disclosure provides a cover assembly.

A second aspect of the disclosure provides a packaging box.

The first aspect of the disclosure provides a cover assembly comprising: a shield provided with an opening; a sliding cover slidably arranged on the shield; a lid located between the shield and the sliding cover and rotatably connected to the shield, so that the opening can be opened or closed under the drive of the sliding cover.

The disclosure provides a cover assembly which comprises a shield, a sliding cover and a lid. Wherein, the shield is provided with an opening which can be used as a discharge port when the cover assembly is installed to the box body of the packaging box; the lid is arranged at the position of the opening, and the sliding cover is slidably installed on the shield and can drive the lid to move during the sliding process, so that the lid opens or closes the opening.

Specifically, when the sliding cover slides in one direction, the sliding cover can drive the lid to move during the sliding process, so that the lid opens the opening on the shield, and then candies, medicine and other foodstuff in the box body can be taken out from the opening. When the sliding cover slides in another direction, the sliding cover can drive the lid to move during the sliding process, so that the lid closes the opening on the shield, and then the foodstuff can be prevented from being exposed from the box body.

In addition, the disclosure drives the lid to move by means of the sliding cover during the sliding process, so as to open or close the opening. On the one hand, effectively sealing of the opening can be realized by utilizing the lid, which avoids the exposure of stuff in the box body of the packaging box, on the other hand, the lid can be driven by utilizing the sliding cover directly, which simplifies the overall structure and can reduce the number of parts of the cover assembly, thereby resulting in a compact structure of the packaging box adopting the cover assembly and can reduce the cost of the cover assembly at the same time. In addition, the opening or closing of the opening on the shield by way of sliding conforms to a user's using habits, facilitates the user's daily operation, and is very compact and convenient. Moreover, compared with the existing structure which usually requires the user to operate with both hands, the cover assembly of the disclosure requires only one hand to open or close the opening, providing the user with an interesting and dynamic way of opening and closing.

The cover assembly provided by the disclosure can directly drive the lid to move through the sliding cover during the sliding process, so that the lid can open or close the opening, with the whole structure being small and delicate, easy to operate for the user, and at the same time reducing the cost of the cover assembly to ensure the storage of foodstuff inside the box body of the packaging box.

The cover assembly according to the above technical solution of the disclosure may also have the following additional technical features:

In the above technical solution, the lid comprises: a lid body; a first rotating shaft arranged on the lid body and rotatably connected to the shield; a raised portion arranged on a wall surface of the lid facing the sliding cover; wherein the raised portion can be pushed by the sliding cover when the sliding cover slides in one direction, so as to drive the lid body to open the opening, and the lid body can be pushed by the sliding cover when the sliding cover slides in the opposite direction, so as to drive the lid body to close the opening.

In this technical solution, the lid comprises a lid body, a first rotating shaft and a raised portion. Wherein, the first rotating shaft is arranged on the lid body and is rotatably connected to the shield, so that the lid body is rotatably arranged above the opening; the raised portion is arranged on a wall surface of the lid body facing the sliding cover and is arranged protruding from the lid body to ensure that the raised portion can be pushed by the sliding cover during its sliding in one direction therein, and further the raised portion is driven to drive the lid body to rotate, and thereby open the opening on the shield; when the opening is in an open state, the lid body is in an upright state, and the lid body can be pushed during the sliding of the sliding cover in the other direction, thereby the lid body is driven to close the opening.

In any of the above technical solutions, the lid further comprises a second rotating shaft protruding from the raised portion; the shield is provided with a guide groove, and the second rotating shaft is located in the guide groove when the lid body opens the opening.

In this technical solution, the lid further comprises a second rotating shaft, and the shield is provided with a guide groove that is used in cooperation with the second rotating shaft. Wherein, the second rotating shaft is arranged protruding from the side wall of the raised portion, and when the lid body opens the opening, the second rotating shaft is located in the guide groove and abuts against the inner wall of the guide groove, so as to play a role of supporting the lid body and ensure that the lid body is stably in an upright state.

In any of the above technical solutions, when the lid body closes the opening, the angle formed between the lid body and the plane where the opening lies is less than or equal to 90°; wherein the opening and the angle are located on the same side of the lid body.

In this technical solution, when the lid body opens the opening at the maximum opening angle, the lid body is in an upright state and forms an angle with the plane where the opening lies, which is less than or equal to 90°. In this way, it can be ensured that in the open state, the inclination angle of the lid body relative to the plane where the opening lies is less than or equal to 90°, ensuring that the lid body can be back in position smoothly when the sliding cover slides towards the other direction of the shield. Specifically, the opening and the angle are located on the same side of the lid body, that is, the above angle can be understood as the maximum rotation angle of the lid body.

In any of the above technical solutions, when the lid body closes the opening, the angle formed between the lid body and the plane where the opening lies is greater than 90°; wherein the opening and the angle are located on the same side of the lid body.

In this technical solution, when the lid body opens the opening at the maximum opening angle, the lid body is in an upright state and forms an angle with the plane where the opening lies, which is greater than 90°. In this way, it can be ensured that there is sufficient space between the lid body in the upright state and the plane where the opening lies, which is more beneficial to taking out the stuff such as candies and medicine in the box body, and is convenient for operation. Specifically, the opening and the angle are located on the same side of the lid body, that is, the above angle can be understood as the maximum rotation angle of the lid body.

In any of the above technical solutions, the shield is provided with a receiving groove, and the opening is provided on the bottom wall of the receiving groove; the lid body can be received in the receiving groove, and the raised portion is located outside the receiving groove.

In this technical solution, the shield is provided with a receiving groove. Wherein, the opening is arranged on the bottom wall of the receiving groove. When the lid body closes the opening on the shield, the lid body and the first rotating shaft are both located inside the receiving groove, which ensures the miniaturization and slim design of the cover assembly on the one hand, and avoids the lid body and the first rotating shaft from affecting the sliding of the sliding cover on the other hand.

In addition, when the lid body closes the opening on the shield, the raised portion is located outside the receiving groove to ensure that the raised portion can be pushed by the sliding cover during the sliding process, so as to ensure that the sliding cover can drive the lid body to rotate to open the opening on the shield by means of the raised portion.

In any of the above technical solutions, the shield comprises: a shield body on which the opening is provided; a moving element arranged on the side of the shield body facing the sliding cover, and the sliding cover is arranged over the moving element and is slidably connected to the moving element.

In this technical solution, the shield comprises a shield body and a moving element. Wherein, the shield body is provided with the above opening, the moving element is arranged on the shield body and is located on a side of the shield body facing the sliding cover; the sliding cover is arranged over the moving element and can be directly slidably connected to the moving element, ensuring that the sliding cover can be pushed by the user. In addition, the moving element located under the sliding cover can further play a role of supporting the sliding cover, preventing the sliding cover from being dented and deformed due to the collision of external force and ensuring the service life of the cover assembly.

In any of the above technical solutions, the side wall of the moving element is provided with a guide protrusion or guide slot which extends along the sliding direction of the sliding cover; the sliding cover has a peripheral edge which is slidably connected to the guide protrusion or guide slot.

In this technical solution, the side wall of the moving element is provided with a guide protrusion or a guide slot, and the sliding cover has a peripheral edge. Wherein, the guide protrusion or guide slot extends along the sliding direction of the sliding cover, while the peripheral edge of the sliding cover is slidably connected to the guide protrusion or guide slot, which ensures that the sliding cover can slide along the extending direction of the guide protrusion or guide slot, and further ensures the position limiting between the sliding cover and the moving element in the thickness direction of the cover assembly, and prevents the sliding cover from breaking away from the moving element during use.

In any of the above technical solutions, the moving element is located on the side of the opening; the moving element has an abutting surface on the side facing the opening, and the sliding cover can abut against the abutting surface.

In this technical solution, the moving element is located on the side of the opening, and the moving element is provided with an abutting surface. Wherein, the abutting surface is located on a side of the moving element facing the opening, and can be used for limiting the abutting position of the sliding cover.

Specifically, the sliding cover slides towards one direction of the shield, and drives the lid to move during the sliding process, so that the lid opens the opening on the shield, and then the sliding cover slides to the farthest distance and abuts against the abutting surface, ensuring that the abutting surface limits the sliding travel of the sliding cover to avoid damage to the lid due to excessive sliding of the sliding cover.

In any of the above technical solutions, the shield further comprises: a clamping portion protruding from the side of the shield body facing the sliding cover, and the clamping portion is arranged away from the moving element, and the sliding cover can be clamped on the clamping portion.

In this technical solution, the shield further comprises a clamping portion. Wherein, the clamping portion is arranged on a side of the shield body facing the sliding cover, and is arranged protruding from the shield body. The clamping portion and the moving element are located on opposite sides of the lid, and the sliding cover can be clamped on the clamping portion.

Specifically, when the lid closes the opening, the sliding cover is clamped on the clamping portion, thereby ensuring the role of positioning the sliding cover, avoiding accidental sliding of the sliding cover, and preventing the sliding cover from breaking away from the moving element due to excessive sliding.

In any of the above technical solutions, the shield body, the moving element and the clamping portion are of an integrated structure.

In this technical solution, the shield body, the moving element and the clamping portion are of an integrated structure, and can be integrally processed and formed. In this way, on the one hand, the manufacturing process of the shield can be reduced, and on the other hand, the strength of the shield itself can be ensured, so as to ensure the service life of the cover assembly.

In any of the above technical solutions, the lid body, the first rotating shaft, the raised portion and the second rotating shaft are of an integrated structure.

In this technical solution, the lid body, the first rotating shaft, the raised portion and the second rotating shaft are of an integrated structure, which can be integrally processed and formed and assembled to the shield. In this way, on the one hand, the manufacturing process of the lid can be reduced, and on the other hand, the strength of the lid itself can be ensured, so as to ensure the service life of the cover assembly.

In any of the above technical solutions, the cover assembly further comprises: a decoration portion arranged on a wall surface of the sliding cover away from the shield.

In this technical solution, the cover assembly further comprises a decoration portion. Wherein, the decoration portion is arranged on a wall surface of the sliding cover away from the shield, so as to enhance the appearance aesthetics of the cover assembly, and at the same time, it serves as a mark for distinguishing.

Specifically, a decoration layer can be adopted for the decoration portion and cover the wall surface of the sliding cover away from the shield, and the decoration layer can be provided with commodity information and patterns, etc.

In any of the above technical solutions, the shield is a plastic piece.

In this technical solution, the shield may adopt a plastic piece. Wherein, the plastic piece has good plasticity, and can provide a good insulating effect between the sliding cover and the box body of the packaging box, especially when the box body and the sliding cover both adopt metal pieces, avoid rigid contact, and at the same time eliminate the noise during the sliding process of the sliding cover.

In any of the above technical solutions, the sliding cover is a metal piece.

In this technical solution, the sliding cover is a metal piece. The metal piece has good rigidity and hardness, which can bear larger external force, avoid the deformation or depression of the sliding cover due to the collision of external force, and ensure the service life of the cover assembly.

In any of the above technical solutions, the lid is a plastic piece.

In this technical solution, the lid is a plastic piece. Plastic pieces have good shaping and sealing properties. In this way, on the one hand, it can ensure that no noise will occur due to collision when the lid opens and closes the opening, on the other hand, it ensures the sealing of the opening, which in turn ensures the preservation effect of the foodstuff inside the box.

A second aspect of the disclosure provides a packaging box comprising: a box body having a cavity; a cover assembly according to the first aspect of the disclosure, wherein the shield is connected to the box body, and the opening is communicated to the cavity.

The packaging box provided by the disclosure comprises a box body and the cover assembly according to any of the above technical solutions. Therefore, the packaging box has all the beneficial effects of the above cover assembly, which will not be discussed again herein.

Specifically, the box body has a cavity which can be used to store stuff such as candies and medicine. The shield is connected to the box body, and the opening on the shield is communicated to the cavity of the box body. Driving the sliding cover to slide enables the lid to open or close the opening on the shield, so that the user can take out foodstuff from the cavity.

Additional aspects and advantages of the disclosure will become apparent in the description sections that follow or will be learned through the practice of the disclosure.

BRIEF DESCRIPTION OF THE DRAWINGS

The above and/or additional aspects and advantages of the disclosure will become apparent and readily understood in combination with the description of embodiments in the following accompanying drawings, wherein.

Figure 1:
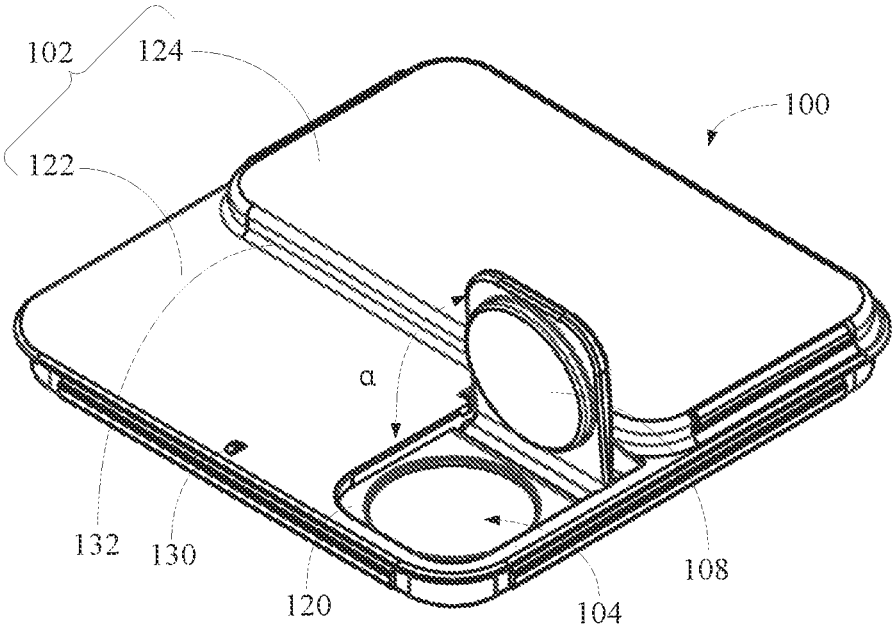
FIG. 1 is an illustrative structural diagram of a cover assembly according to one embodiment of the disclosure (not showing the sliding cover)

Among them, the corresponding relationship between the reference numerals and the component names in FIG. 1 to FIG. 15 is:

100 cover assembly, 102 shield, 104 opening, 106 sliding cover, 108 lid, 110 lid body, 112 first rotating shaft, 114 raised portion, 116 second rotating shaft, 118 guide groove, 120 receiving groove, 122 shield body, 124 moving element, 126 guide protrusion, 128 peripheral edge, 130 clamping portion, 132 abutting surface, 200 box body.

DETAILED DESCRIPTION OF THE PREFERRED EMBODIMENTS

In order to be able to understand the above object, features and advantages of the disclosure more clearly, the disclosure will be further described in detail below with reference to the accompanying drawings and specific embodiments. It should be noted that, in the event of no conflict, features in the same embodiment and different embodiments of the disclosure may be combined with each other.

Many specific details are set forth in the following description to facilitate a full understanding of the disclosure. However, the disclosure can also be implemented in other ways different from those described herein. Therefore, the protection scope of the disclosure is not limited by the specific embodiments disclosed below.

The cover assembly 100 and the packaging box provided according to some embodiments of the disclosure will be described below with reference to FIGS. 1 to 14. The solid arrow in FIG. 2 indicates the sliding direction of the sliding cover 106 when the opening 104 is being opened, and the dashed arrow indicates the sliding direction of the sliding cover 106 when the opening 104 is being closed.

Figure 2:
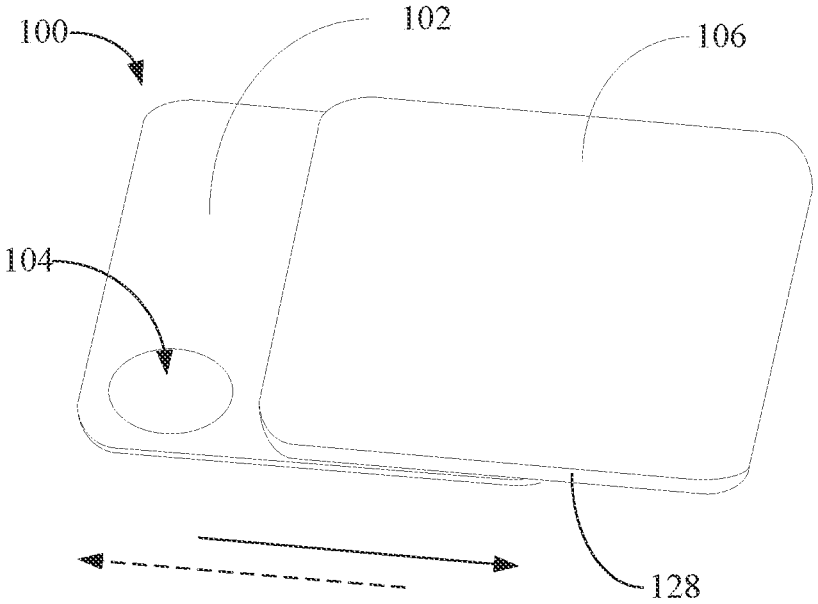
FIG. 2 is an illustrative structural diagram of a cover assembly according to one embodiment of the disclosure (not showing the lid)

As shown in FIGS. 1 and 2, the first embodiment of the disclosure provides a cover assembly 100 which comprises a cover 102, a sliding cover 106 and a lid 108.

Wherein, the shield 102 is provided with an opening 104 which can be used as a discharge port when the cover assembly 100 is installed to the box body 200 of the packaging box; the lid 108 is arranged at the position of the opening 104, and the sliding cover 106 is slidably installed on the shield 102 and can drive the lid 108 to move during the sliding process, so that the lid 108 opens or closes the opening 104.

Specifically, as shown in FIG. 2, when the sliding cover 106 slides in the direction indicated by the solid arrow, the sliding cover 106 can drive the lid 108 to move during the sliding process, so that the lid 108 opens the opening 104 on the shield 102, and then the stuff can be taken out from the opening 104. When the sliding cover 106 slides in the direction indicated by the dashed arrow, the sliding cover 106 can drive the lid 108 to move during the sliding process, so that the lid 108 closes the opening 104 on the shield 102, and then the stuff can be prevented from exposed from inside of the box body 200 of the packaging box.

In addition, in this embodiment, the lid 108 is driven to move by the sliding cover 106 during the sliding process, so as to open or close the opening 104. On the one hand, effectively sealing of the opening 104 can be realized by utilizing the lid 108, which facilitates the storage of stuff in the box body 200 of the packaging box, on the other hand, the lid 108 can be driven by utilizing the sliding cover 106 directly, which simplifies the overall structure and can reduce the number of parts of the cover assembly 100, thereby resulting in a compact structure of the packaging box adopting the cover assembly 100 and can reduce the cost of the cover assembly 100 at the same time.

In addition, the opening or closing of the opening 104 on the shield 102 by way of sliding conforms to a user's using habits, facilitates the user's daily operation, and is very compact and convenient. Moreover, compared with the existing structure which usually requires the user to operate with both hands, the cover assembly 100 of the disclosure requires only one hand to open or close the opening 104, providing the user with an interesting and dynamic way of opening and closing.

Therefore, the cover assembly 100 provided by the embodiment can directly drive the lid 108 to move through the sliding cover 106 during the sliding process, so that the lid can open or close the opening, with the whole structure being small and delicate, easy to operate for the user, and at the same time reducing the cost of the cover assembly to ensure the storage of foodstuff inside the box body of the packaging box.

The second embodiment of the disclosure provides a cover assembly 100 on the basis of the first embodiment, which further provides:

As shown in FIGS. 7, 8, 9, 10 and 11, the lid 108 comprises a lid 110, a first rotating shaft 112 and a raised portion 114. The first rotating shaft 112 is arranged on the lid body 110 and is rotatably connected to the shield 102, so that the lid body 110 is rotatably arranged above the opening 104; the raised portion 114 is arranged on a side of the lid body 110 facing the sliding cover 106 and is arranged protruding from the lid body 110 to ensure that the raised portion 114 can be pushed by the sliding cover 106 during its sliding in the direction indicated by the solid arrow, and then the raised portion 114 is driven to drive the lid body 110 to rotate, so that the lid body 110 opens the opening 104 on the shield 102; when the opening 104 is in the open state, the lid body 110 is in an upright state, and the lid body 110 can be pushed during the sliding process of the sliding cover in the other direction, so that the lid body 110 is driven to close the opening 104.

Specifically, as shown in FIG. 2, when the sliding cover 106 slides in the direction indicated by the solid arrow, the sliding cover 106 can push one side of the raised portion 114 during the sliding process, and at this time the raised portion 114 drives the lid body 110 to rotate to one side, and the lid body 110 opens the opening 104 on the shield 102; when the opening 104 is in the open state, the lid body 110 is in an upright state, while the raised portion 114 is in a horizontally arranged state; when the sliding cover 106 slides in the direction indicated by the solid arrow, the sliding cover 106 can pushed the lid body 110 during the sliding process, and at this time the lid body 110 rotates toward the other side, and the lid body 110 closes the opening 104 on the shield 102.

Figure 3:
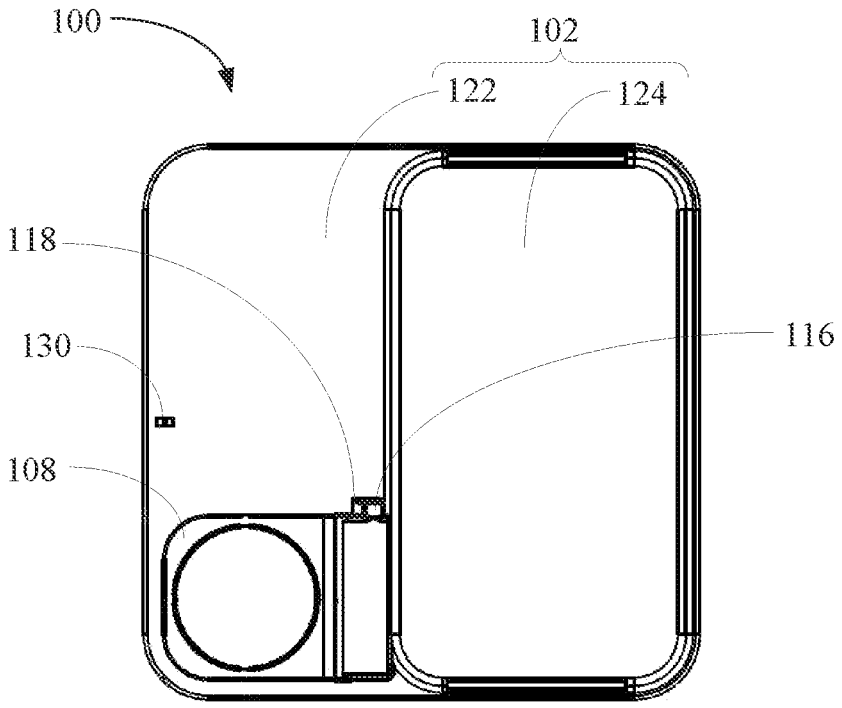
FIG. 3 is a top view of the cover assembly shown in FIG. 1.
Figure 4:
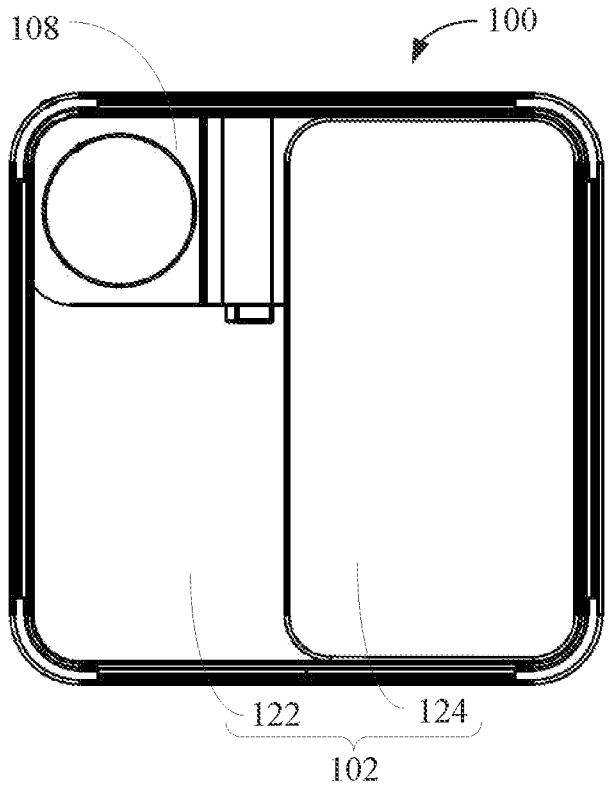
FIG. 4 is a bottom view of the cover assembly shown in FIG. 1.

In this embodiment, further, as shown in FIG. 3, the lid 108 further comprises a second rotating shaft 116, and the shield 102 is provided with a guide groove 118 that is used in cooperation with the second rotating shaft 116. The second rotating shaft 116 is arranged protruding from the side wall of the raised portion 114, and when the lid body 110 opens the opening 104, the second rotating shaft 116 is located in the guide groove 118 and abuts against the inner wall of the guide groove 118, so as to play the role of supporting the lid body 110 and ensure that the lid body 110 is stably in an upright state.

In a specific embodiment, as shown in FIG. 1, when the lid body 110 opens the opening 104 at the maximum opening angle, the lid body 110 is in an upright state, and an angle $\alpha$ is formed between the lid body 110 and the plane where the opening 104 lies, which is less than or equal to 90°. In this way, it ensures that in the open state, the inclination angle of the lid body 110 relative to the plane where the opening 104 lies is less than or equal to 90°, ensuring that the lid body 110 can be back in position smoothly when the sliding cover 106 slides towards the other direction of the shield 102.

In a specific embodiment, when the lid body 110 opens the opening 104 at the maximum opening angle, the lid body 110 is in an upright state and forms an angle $\alpha$ with the plane where the opening 104 lies, which is greater than 90°. In this way, sufficient space can between the lid body 110 in the upright state and the plane where the opening 104 lies, which is more beneficial to taking out the stuff such as candies and medicine in the box body 200, and is convenient for operation.

Specifically, the opening 104 and the angle $\alpha$ are located on the same side of the lid body 110, that is, the above angle $\alpha$ can be understood as the maximum rotation angle of the lid body 110. Specifically, the plane where the opening 104 lies is the end surface of the shield body 122.

In this embodiment, further, as shown in FIG. 7, FIG. 8, FIG. 9, FIG. 10 and FIG. 11, the lid body 110, the first rotating shaft 112, the raised portion 114 and the second rotating shaft 116 are of an integrated structure, which can be integrally processed and formed and assembled to the shield 102. In this way, on the one hand, the manufacturing process of the lid 108 can be reduced, and on the other hand, the strength of the lid 108 itself can be ensured, so as to ensure the service life of the cover assembly 100.

The third embodiment of the disclosure provides a cover assembly 100 on the basis of the first embodiment, which further provides:

As shown in FIG. 1, the shield 102 is provided with a receiving groove 120. Wherein, the opening 104 is arranged on the bottom wall of the receiving groove 120. When the lid body 110 closes the opening 104 on the shield 102, the lid body 110 and the first rotating shaft 112 are both located inside the receiving groove 120, which ensures the miniaturization and slim design of the cover assembly 100 on the one hand, and avoids the lid body 110 and the first rotating shaft 112 from affecting the sliding of the sliding cover 106 on the other hand.

In addition, when the lid body 110 closes the opening 104 on the shield 102, the raised portion 114 is located outside the receiving groove 120 to ensure that the raised portion 114 can be pushed by the sliding cover 106 during the sliding process, so as to ensure that the sliding cover 106 can slide through the raised portion 114 to drive the lid body 110 to rotate to open the opening 104 on the shield 102.

The fourth embodiment of the disclosure provides a cover assembly 100 on the basis of the first embodiment, which further provides:

As shown in FIGS. 3, 4, 5 and 6, the shield 102 comprises a shield body 122 and a moving element 124. The shield body 122 is provided with the above opening 104, the moving element 124 is arranged on the shield body 122 and is located on a side of the shield body 122 facing the sliding cover 106; the sliding cover 106 is arranged over the moving element 124 and can be directly slidably connected to the moving element 124, ensuring that the sliding cover 106 can be pushed by the user. In addition, the moving element 124 located under the sliding cover 106 can further play a role of supporting the sliding cover 106, preventing the sliding cover 106 from being dented and deformed due to the collision of external force and ensuring the service life of the cover assembly 100.

Figure 6:
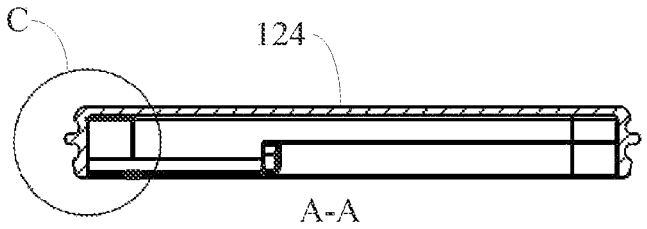
FIG. 6 is a cross-sectional view of the cover assembly shown in FIG. 5 taken along A-A.
Figure 7:
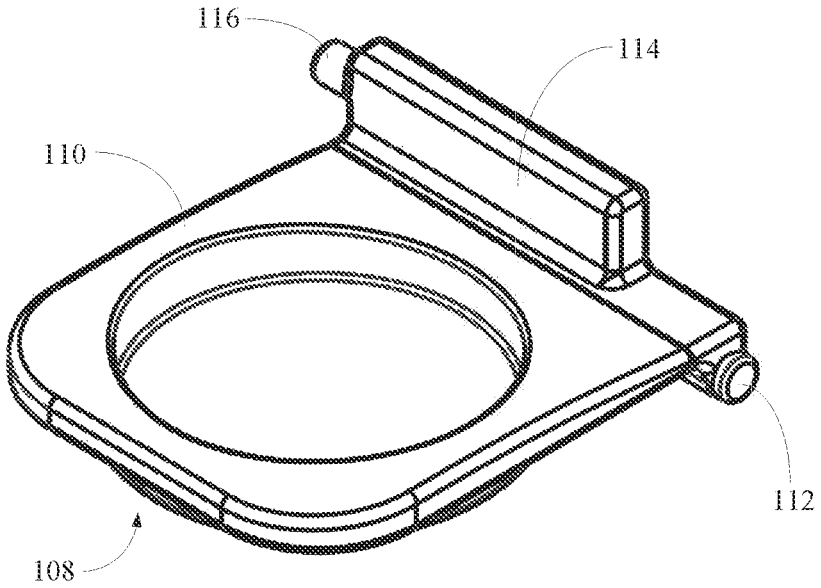
FIG. 7 is a schematic structural diagram of a lid in the cover assembly shown in FIG. 1.
Figure 8:
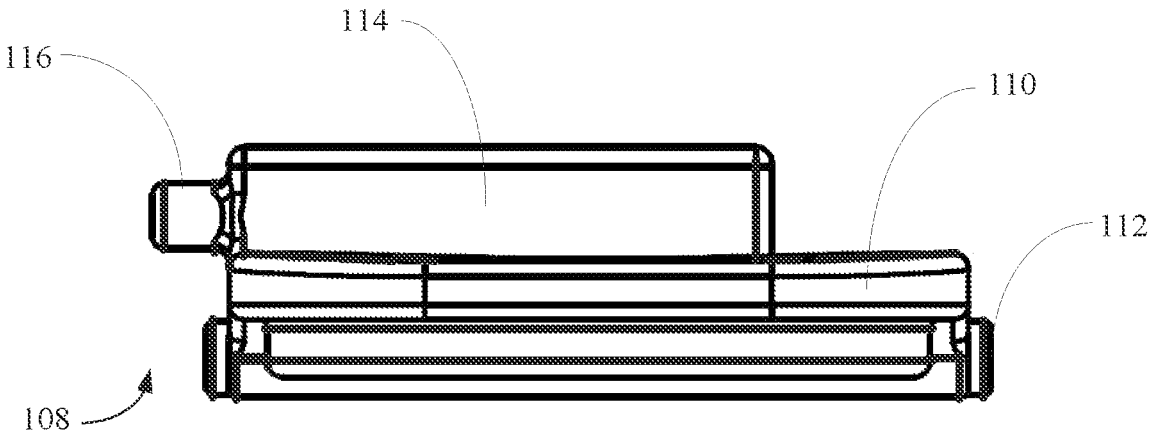
FIG. 8 is a side view of the lid shown in FIG. 7.
Figure 9:
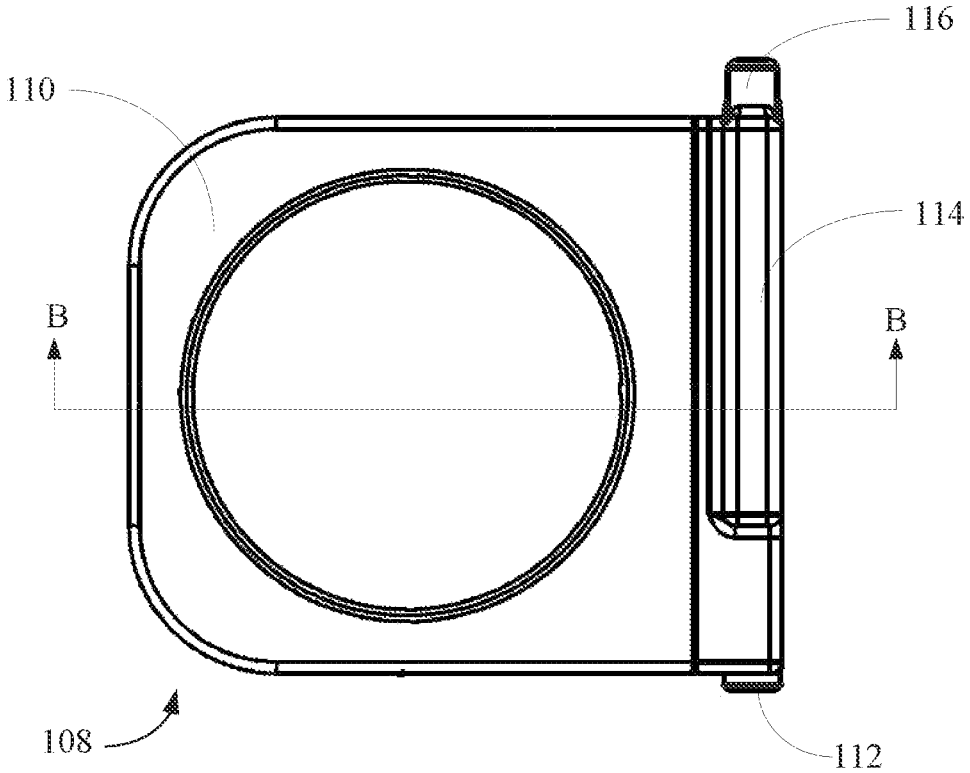
FIG. 9 is a top view of the lid shown in FIG. 7.
Figure 10:
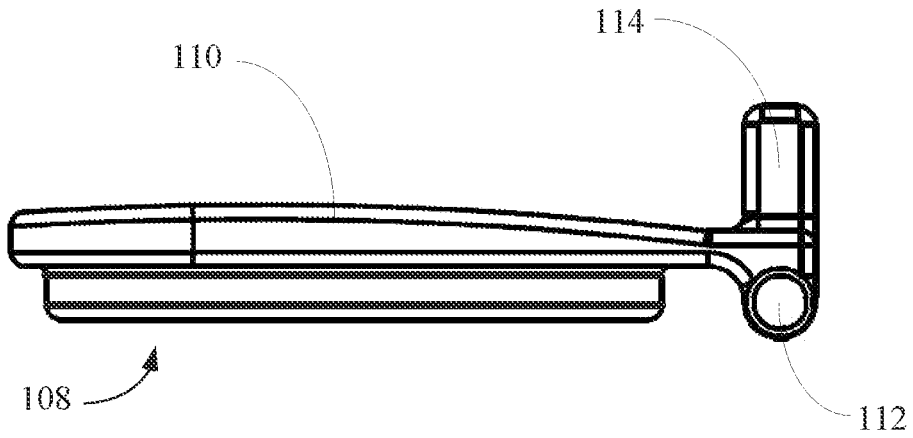
FIG. 10 is a front view of the lid shown in FIG. 7.
Figure 11:
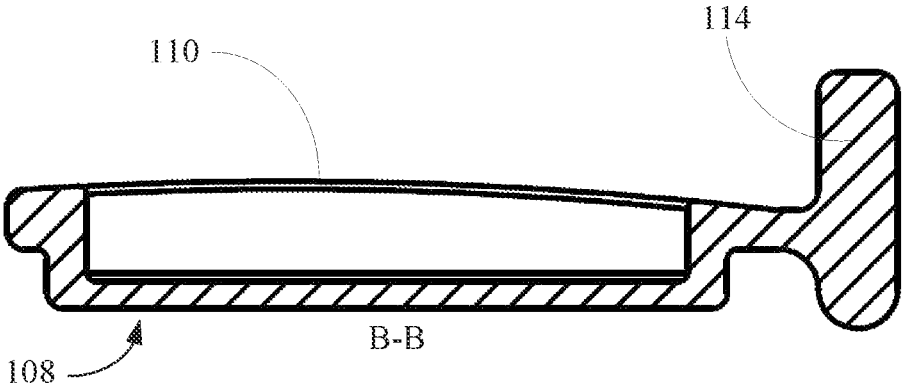
FIG. 11 is a cross-sectional view of the lid shown in FIG. 9 taken along B-B.
Figure 12:
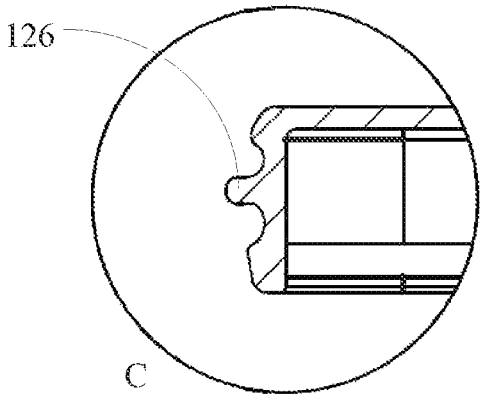
FIG. 12 is a partial enlarged view of part C of the cover assembly shown in FIG. 6.

In this embodiment, as shown in FIG. 2, FIG. 6 and FIG. 12, the side wall of the moving element 124 is further provided with a guide protrusion 126, and the sliding cover 106 has a peripheral edge 128. Wherein, the guide protrusion 126 extends along the sliding direction of the sliding cover 106, and the peripheral edge 128 of the sliding cover 106 is slidably connected to the guide protrusion 126, which ensures that the sliding cover 106 can slide along the extension direction of the guide protrusion 126, and further ensures the position limiting between the sliding cover 106 and the moving element 124 in the thickness direction of the cover assembly 100, and prevents the sliding cover 106 from breaking away from the moving element 124 during use.

In another embodiment, a guide slot (not shown in the figure) can also be adopted to replace the guide protrusion 126, while the edge of the sliding cover 106 adopting a structure matching the guide slot, which can also realize the sliding of the sliding cover 106 along the extension direction of the guide slot, and further ensures the position limiting between the sliding cover 106 and the moving element 124 and prevents the sliding cover 106 from breaking away from the moving element 124 during use.

In this embodiment, further, as shown in FIG. 1, the moving element 124 is located on the side of the opening 104, and the moving element 124 is provided with an abutting surface 132. Wherein, the abutting surface 132 is located on a side of the moving element 124 facing the opening 104, and can be used for limiting the abutting position of the sliding cover 106.

Specifically, as shown in FIG. 2, when the opening 104 is to be opened, the sliding cover 106 slides towards one direction of the shield 102, and drives the lid 108 to move during the sliding process, so that the lid 108 opens the opening 104 on the shield 102, and then the sliding cover 106 slides to the farthest distance and abuts against the abutting surface 132, ensuring that the abutting surface 132 limits the sliding travel of the sliding cover 106 to avoid damage to the lid 108 due to excessive sliding of the sliding cover 106.

In this embodiment, further, as shown in FIG. 1, FIG. 3, FIG. 5 and FIG. 13, the shield 102 further comprises a clamping portion 130. Wherein, the clamping portion 130 is arranged on a wall surface of the shield body 122 facing the sliding cover 106 and is arranged protruding from the shield body 122. The clamping portion 130 and the moving element 124 are located on opposite sides of the lid 108, and the sliding cover 106 can be clamped on the clamping portion 130.

Specifically, when the lid 108 closes the opening 104, the sliding cover 106 is clamped on the clamping portion 130, thereby ensuring the role of positioning the sliding cover 106 and preventing the sliding cover 106 from sliding accidentally.

Figure 5:
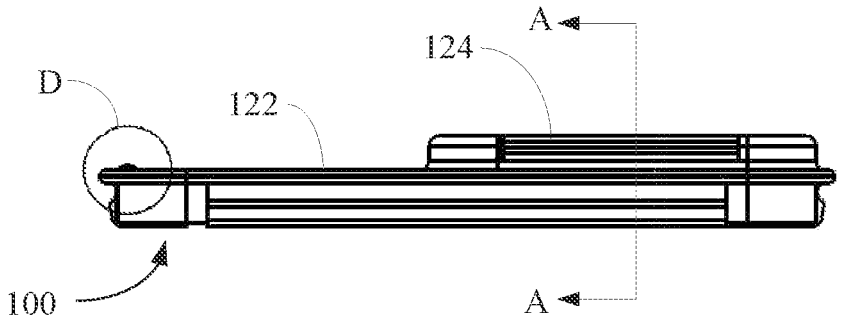
FIG. 5 is a side view of the cover assembly shown in FIG. 1.

In this embodiment, further, as shown in FIG. 5 and FIG. 6, the shield body 122, the moving element 124 and the clamping portion 130 are of an integrated structure, and can be integrally processed and formed. In this way, on the one hand, the manufacturing process of the shield 102 can be reduced, and on the other hand, the strength of the shield 102 itself can be ensured, so as to ensure the service life of the cover assembly 100.

The fifth embodiment of the disclosure provides a cover assembly 100 on the basis of the first embodiment, which further provides:

The cover assembly 100 further comprises a decoration portion (not shown in the figure). Wherein, the decoration portion is arranged on the side of the sliding cover 106 away from the shield 102, so as to enhance the appearance aesthetics of the cover assembly 100, and at the same time, it serves as a mark for distinguishing.

Specifically, a decoration layer can be adopted for the decoration portion and cover the side of the sliding cover 106 away from the shield 102, and the decoration layer can be provided with commodity information and patterns, etc.

On the basis of the first embodiment to the fifth embodiment, further, the shield 102 can adopt a plastic piece. Wherein, the plastic piece has good plasticity, and can provide a good insulating effect between the sliding cover and the box body 200 of the packaging box, especially when the box body 200 and the sliding cover 106 both adopt metal pieces, avoid rigid contact, and at the same time eliminate the noise during the sliding process of the sliding cover 106.

On the basis of the first embodiment to the fifth embodiment, further, the sliding cover 106 is a metal piece. The metal piece has good rigidity and hardness, which can bear larger external force, avoid the deformation or depression of the sliding cover 106 due to the collision of external force, and ensure the service life of the cover assembly 100.

On the basis of the first embodiment to the fifth embodiment, further, the lid 108 is a plastic piece. Plastic pieces have good shaping and sealing properties. In this way, on the one hand, it can ensure that the lid 108 will not generate noise due to collision when opening and closing the opening 104, and on the other hand, the sealing of the opening 104 can be ensured, thereby ensuring the preservation effect of the food in the box body 200.

Figure 14:
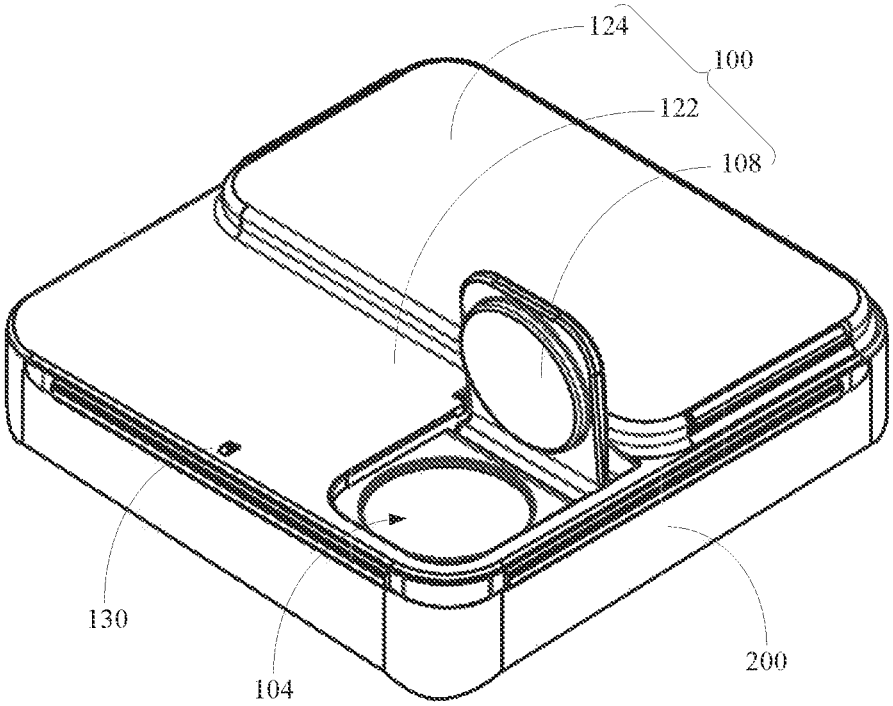
FIG. 14 is an illustrative structural diagram of a packaging box according to one embodiment of the disclosure.

As shown in FIG. 14, the sixth embodiment of the disclosure provides a packaging box provided by the disclosure, which comprises a box body 200 and the cover assembly 100 of any of the above embodiments.

The packaging box provided by the embodiment of the disclosure comprises the cover assembly 100 of any of the above embodiments. Therefore, all the beneficial effects of the cover assembly 100 described above will not be further discussed here one by one.

Specifically, as shown in FIG. 14, the box body 200 has a cavity which can be used to store stuff such as candies and medicine. The shield 102 is connected to the box body 200, and the opening 104 on the shield 102 is communicated to the cavity of the box body 200. Driving the sliding cover to slide enables the lid 108 to open or close the opening 104 on the shield 102, so that the user can take out foodstuff from the cavity.

In a specific embodiment, the box body 200 is a metal piece. In this way, the sliding cover 106 and the box body 200 are both metal pieces, which ensures the strength and service life of the packaging box. The shield 102 adopts a plastic piece, and is located between the box body 200 and the sliding cover 106, and plays a role of good cushioning transition.

As shown in FIG. 14, the first specific embodiment of the disclosure provides a packaging box, which can be used to store foodstuff such as candies. Wherein, the packaging box comprises a cover assembly 100 and a box body 200.

Specifically, as shown in FIGS. 1, 2, 3 and 4, the cover assembly 100 comprises a shield 102, a sliding cover 106 and a lid 108. The shield 102 is provided with an opening 104, the lid 108 is arranged at the position of the opening 104, the sliding cover 106 is slidably installed on the shield 102, and can drive the lid 108 to move during the sliding process, so that the lid 108 opens or closes the opening 104.

Specifically, as shown in FIGS. 7, 8, 9, 10 and 11, the lid 108 comprises a lid 110, a first rotating shaft 112, a raised portion 114 and a second rotating shaft 116. The lid body 110 is rotatably connected to the shield 102 through the first rotating shaft 112, and is rotatably arranged over the opening 104; the raised portion 114 protrudes from the side of the lid body 110 facing the sliding cover 106, which ensures that the raised portion 114 can be pushed by the sliding cover 106 during its sliding in direction indicated by the solid arrow, and then the raised portion 114 is driven to drive the lid body 110 to rotate, so that the lid body 110 opens the opening 104 on the shield 102; when the opening 104 is in the open state, the lid body 110 is in an upright state, and the lid body 110 can be pushed during the sliding process of the sliding cover in the other direction, so that the lid body 110 is driven to close the opening 104.

In addition, the second rotating shaft 116 cooperates with the guide groove 118 on the shield 102 to ensure the rotation angle of the lid body 110. Specifically, when the lid body 110 closes the opening 104, the second rotating shaft 116 is located in the guide groove 118, and the lid body 110 is in an upright state. At this time, an angle $\alpha$ is formed between the lid body 110 and the plane where the opening 104 lies, and the angle $\alpha$ may be less than or equal to 90° to ensure that the lid body 110 can be back in position smoothly. In addition, the angle $\alpha$ can also be greater than 90°, which is more conducive to taking out the stuff such as candies and medicine in the box body 200 and is convenient for operation.

Specifically, as shown in FIG. 1, the shield 102 is provided with a receiving groove 120, and the opening 104 is provided on the bottom wall of the receiving groove 120. When the lid body 110 closes the opening 104 on the shield 102, the lid body 110 and the first rotating shaft 112 are both located inside the receiving groove 120, and the raised portion 114 is located outside the receiving groove 120.

Specifically, as shown in FIGS. 5 and 6, the shield 102 comprises a shield body 122 and a moving element 124. The shield body 122 is provided with the above opening 104, and the sliding cover 106 is arranged over the moving element 124 and can be slidably connected to the moving element 124 directly. Wherein, the side wall of the moving element 124 is provided with a guide protrusion 126 or a guide slot, the sliding cover 106 has a peripheral edge 128, and the peripheral edge 128 of the sliding cover 106 is slidably connected to the guide protrusion 126 or the guide slot, which ensures that the sliding cover 106 can slide along the extending direction of the guide protrusion 126, and further ensures the position limiting between the sliding cover 106 and the moving element 124 in the thickness direction of the cover assembly 100 at the same time, and prevents the sliding cover 106 from breaking away from the moving element 124 during use.

Figure 13:
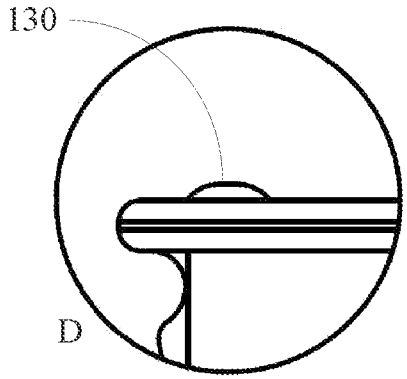
FIG. 13 is a partial enlarged view of part D of the cover assembly shown in FIG. 5.

Specifically, as shown in FIG. 1, the moving element 124 is located on a side of the opening 104, and the moving element 124 is provided with an abutting surface 132 which is located on the side of the moving element 124 facing the opening 104, which can realize the abutting position limit on one side of the sliding cover 106. As shown in FIG. 13, the wall surface of the shield body 122 facing the sliding cover 106 is provided with the clamping portion 130.

Specifically, the lid body 110, the first rotating shaft 112, the raised portion 114 and the second rotating shaft 116 are of an integral structure.

Specifically, the shield body 122, the moving element 124 and the clamping portion 130 are of an integral structure.

Specifically, the cover assembly 100 further comprises a decoration portion. Wherein, a decoration layer can be adopted for the decoration portion and cover the side of the sliding cover 106 away from the shield 102, and the decoration layer can be provided with commodity information and patterns, etc.

Specifically, the shield 102 is a plastic piece, the sliding cover 106 is a metal piece, the lid 108 is a plastic piece, and the box body 200 is a metal piece.

Figure 15:
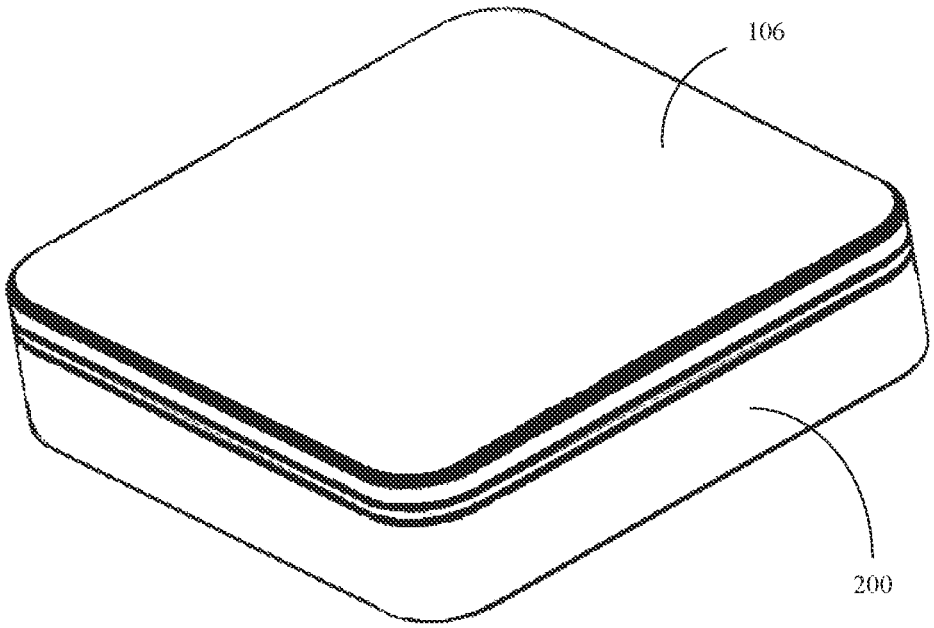
FIG. 15 is an illustrative structural diagram the embodiment shown in FIG. 14 after adding a sliding cover.

FIG. 15 is a illustrative structural diagram of the embodiment shown in FIG. 14 after adding a sliding cover, wherein the sliding cover 106 completely covers the box body 200 after returning to its position, so that the packaging box of the disclosure, when closed, can ensure the foodstuff or medicine in the box is fully enclosed and remains clean, and the box surface has no additional raised structure, which facilitates handling, storage and transportation.

In the description of the disclosure, the term "a plurality of" refers to two or more than two, and unless otherwise definite defined, an orientation or positional relationship indicated by the terms such as "above", "below" is the orientation or positional relationship based on the accompanying drawings only for the convenience of describing the disclosure and simplifying the description, rather than indicating or implying that the indicated device or element must have a specific orientation, be constructed and operated in a specific orientation, therefore, they should not be construed as a limitation of the disclosure; the terms such as "connected", "installed", "fixed" shall be understood in a broad sense, for example, "connected" can be a fixed connection, a detachable connection, or an integral connection; it can be a direct connection, or an indirect connection through an intermediate media are indirectly connected. Those of ordinary skill in the art can understand the specific meanings of the above terms in the disclosure according to specific situations.

In the description of the specification, the description of the terms such as "one embodiment", "some embodiments", "specific embodiment" means that a particular feature, structure, material or characteristic described in connection with the embodiment or example is included in at least one embodiment or example of the disclosure. In the specification, schematic representations of the above terms do not necessarily refer to the same embodiment or example. Furthermore, the specific features, structures, materials or characteristics described may be combined in a suitable manner in any one or more embodiments or examples.

The above are only preferred embodiments of the disclosure, and are not intended to limit the disclosure. For those skilled in the art, the disclosure may have various modifications and changes. Any modification, equivalent replacement, improvement, etc. made within the spirit and principle of the disclosure shall be included within the protection scope of the disclosure.

The invention claimed is:

1. A cover assembly comprising:

a shield provided with an opening;

a sliding cover slidably arranged on the shield; and a lid positioned between the shield and the sliding cover, and rotatably connected to the shield, wherein sliding the sliding cover rotates the lid so as to open or close the opening, wherein the lid comprises:

a lid body; and a raised portion arranged on a side of the lid body facing the sliding cover such that the raised portion is pushed by the sliding cover when the sliding cover is slid relative to the shield.

2. A cover assembly comprising:

a shield provided with an opening;

a sliding cover slidably arranged on the shield; and a lid positioned between the shield and the sliding cover, and rotatably connected to the shield, wherein the lid comprises:

a lid body;

a first rotating shaft arranged on the lid body and rotatably connected to the shield;

a raised portion arranged on a side of the lid body facing the sliding cover;

wherein the raised portion can be pushed by the sliding cover when the sliding cover slides in one direction, so as to drive the lid body to open the opening, and the lid body can be pushed by the sliding cover when the sliding cover slides in the opposite direction, so as to drive the lid body to close the opening.

3. The cover assembly according to claim 2, wherein:

the lid further comprises a second rotating shaft protruding from the raised portion;

the shield is provided with a guide groove, and the second rotating shaft is located in the guide groove when the lid body opens the opening.

4. The cover assembly according to claim 3, wherein:

an angle formed between the lid body and a plane where the opening lies is less than or equal to 90° when the lid body is at the maximum opening angle;

wherein, the opening and the angle are located on the same side of the lid body.

5. The cover assembly according to claim 3, wherein:

an angle formed between the lid body and a plane where the opening lies is greater than 90° when the lid body is at the maximum opening angle;

wherein, the opening and the angle are located on the same side of the lid body.

6. The cover assembly according to claim 2, wherein:

the shield is provided with a receiving groove, and the opening is provided on a bottom wall of the receiving groove;

the lid body can be received in the receiving groove, and the raised portion is outside the rece 1 vmg groove.

7. The cover assembly according to claim 2, wherein the shield comprises: a shield body on which the opening is arranged;

a moving element arranged on a side of the shield body facing the sliding cover, and the sliding cover is arranged over the moving element and is slidably connected to the moving element.

8. The cover assembly according to claim 7, wherein:

the moving element is provided with a guide protrusion or a guide slot, and the guide protrusion or the guide slot extends along the sliding direction of the sliding cover;

the sliding cover has a peripheral edge slidably connected to the guide protrusion or the guide slot.

9. The cover assembly according to claim 7, wherein:

the moving element is located on a side of the opening;

the moving element has an abutting surface on a side facing the opening, and the sliding cover can abut against the abutting surface.

10. The cover assembly according to claim 7, wherein the shield further comprises:

a clamping portion protruding from a side of the shield body facing the sliding cover, and the clamping portion is arranged away from the moving element, and the sliding cover is clampable to the clamping portion.

11. The cover assembly according to claim 10, wherein:

the shield body, the moving element and the clamping portion are of an integrated structure.

12. The cover assembly according to claim 3, wherein:

the lid body, the first rotating shaft, the raised portion and the second rotating shaft are of an integral structure.

13. The cover assembly according to claim 1, further comprising:

a decoration portion arranged on a side of the sliding cover away from the shield.

14. The cover assembly according to claim 1, wherein:

the shield is a plastic piece; and/or the sliding cover is a metal piece; and/or the lid is a plastic piece.

15. A packaging box comprising:

a box body having a cavity;

the cover assembly according to claim 1, wherein the shield is connected to the box body, and the opening is communicated to the cavity.

* * * * *